United States Patent [19]

Radtke

[11] 4,396,077

[45] Aug. 2, 1983

[54] DRILL BIT WITH CARBIDE COATED CUTTING FACE

[75] Inventor: Robert P. Radtke, Kingwood, Tex.

[73] Assignee: Strata Bit Corporation, Houston, Tex.

[21] Appl. No.: 303,721

[22] Filed: Sep. 21, 1981

[51] Int. Cl.[3] ..... E21B 10/46; E21B 10/60

[52] U.S. Cl. ..... 175/329; 175/393; 175/411; 175/108 A

[58] Field of Search ..... 175/329, 374, 375, 410, 175/ 411; 76/108 A, 108 R; 219/76.16; 51/309; 427/34, 423

[56] References Cited

U.S. PATENT DOCUMENTS

| | | | |
|---|---|---|---|
| 3,286,334 | 11/1966 | Hay | 219/76.16 |
| 3,298,451 | 1/1967 | Eckel et al. | 175/411 |
| 4,246,977 | 1/1981 | Allen | 175/410 |
| 4,265,324 | 5/1981 | Morris et al. | 175/329 |
| 4,285,410 | 8/1981 | Sanford | 175/410 |

*Primary Examiner*—Stephen J. Novosad
*Assistant Examiner*—Joseph Falk
*Attorney, Agent, or Firm*—Neal J. Mosely

[57] ABSTRACT

A drill bit for connection on a drill string has a hollow tubular body with an end cutting face provided with a tungsten carbide coated surface and an exterior peripheral stabilizer surface with cylindrical sintered carbide inserts positioned therein. Nozzle passages extend from the interior of the bit body through the cutting face for receiving a removable and interchangeable nozzle member therein. The cutting face has a plurality of recesses therein which receive, by an interference fit, a plurality of cutting elements of the type known as STRATAPAX, consisting of a cylindrical stud having an angular supporting surface with a cutting disc bonded thereon consisting of sintered carbide having a cutting surface of polycrystalline diamond. The recesses in the cutting face have milled offset recesses adjacent to the edges thereof which are sized and positioned to permit the cutting discs to be partially recessed and to restrain the cutting elements from rotation during use. The cutting face is coated with tungsten carbide to a thickness of 0.012–0.040 in. by means of a high-velocity, high-temperature plasma coating process after the cutting elements are assembled in the bit body. This process coats the steel bit body with tungsten carbide without coating or otherwise affecting the cutting inserts. The coating is metallurgically bonded to the steel bit body and protects against wear during drilling for periods of several hundred hours.

15 Claims, 16 Drawing Figures

FIG. 1
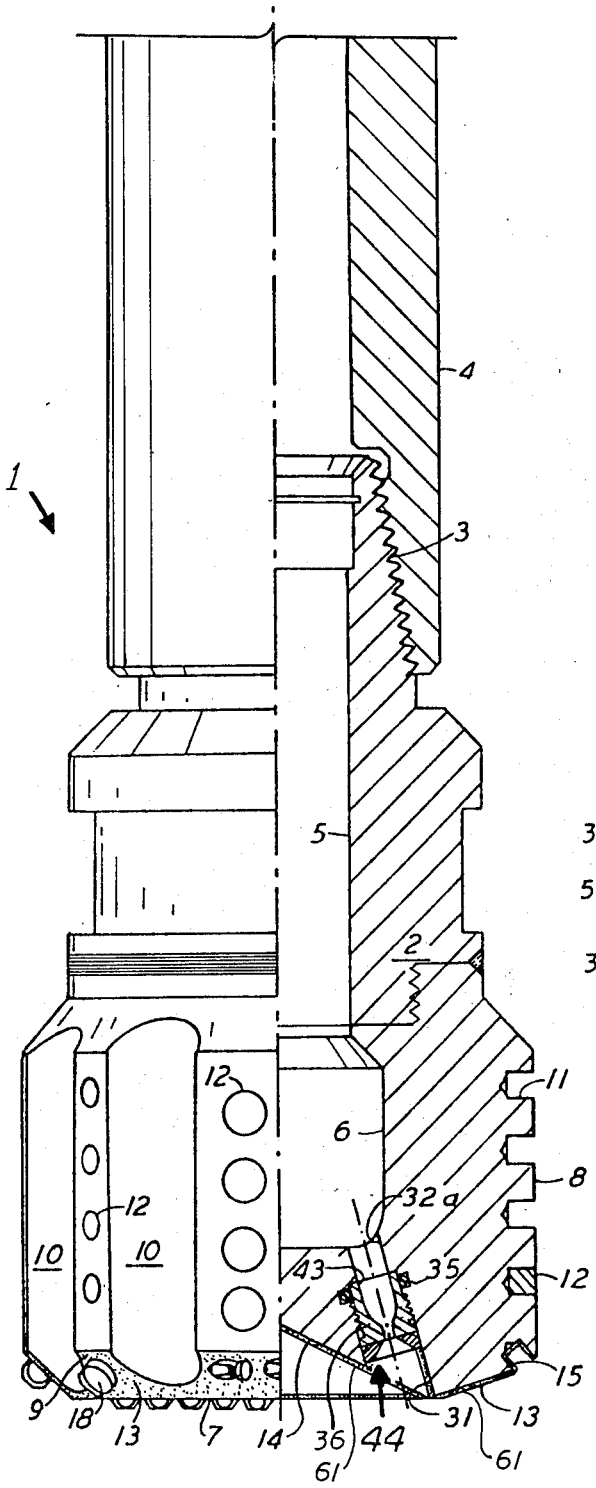
FIG. 3
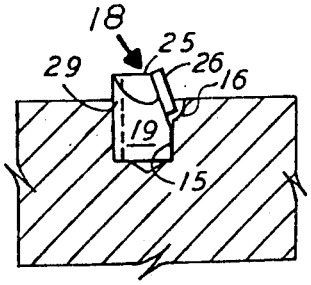
FIG. 4
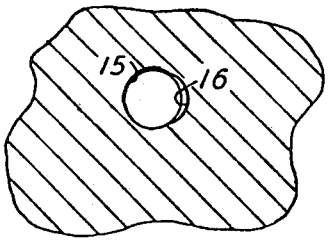
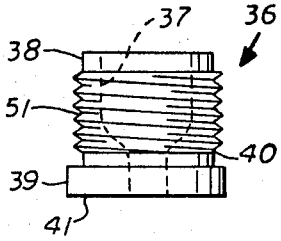
FIG. 8
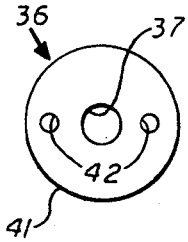
FIG. 9
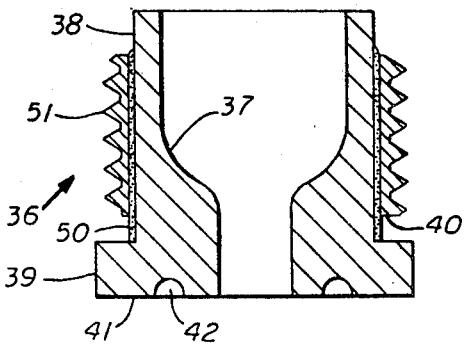
FIG. 8A

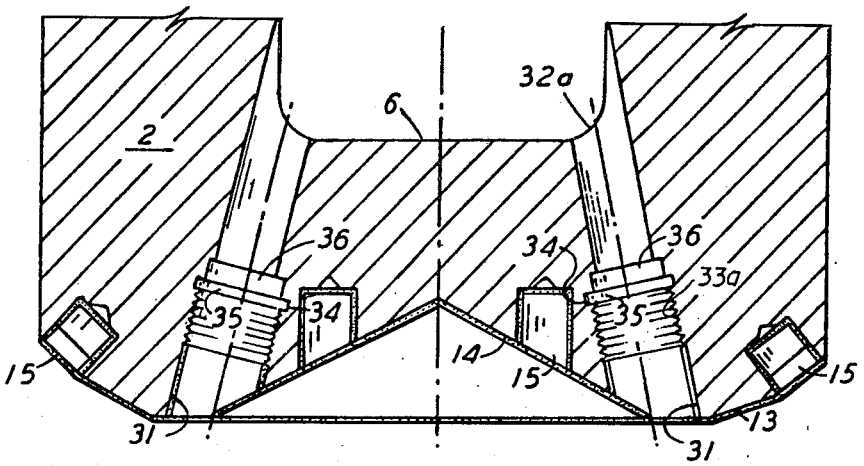
FIG. 10
FIG. 11
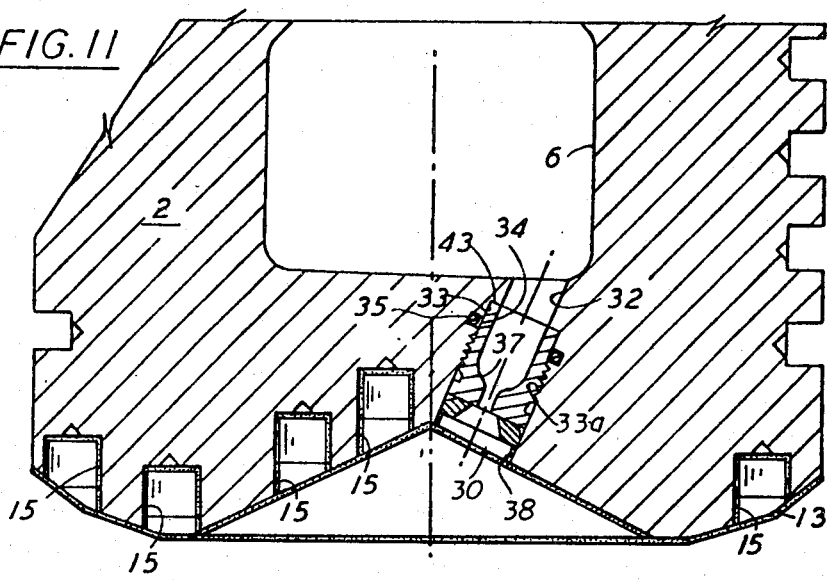
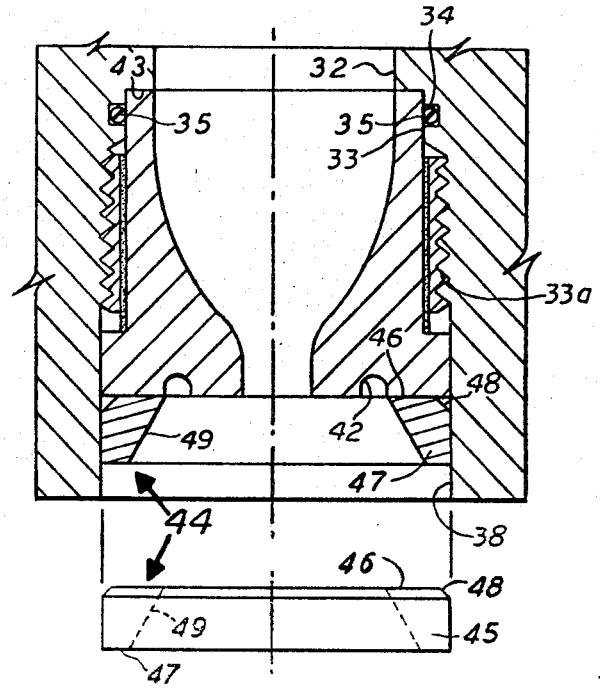
FIG. 12

DRILL BIT WITH CARBIDE COATED CUTTING FACE

CROSS-REFERENCE TO RELATED APPLICATIONS

This application includes subject matter disclosed in part in co-pending applications Ser. No. 220,306, filed Dec. 29, 1980, Ser. No. 158,389, filed June 11, 1980, Ser. No. 296,811, filed Aug. 27, 1981 AND Ser. No. 303,960, filed Sept. 21, 1981.

BACKGROUND OF THE INVENTION

1. Field of the Invention

This invention relates to new and useful improvements in diamond drill bits and particularly to bits in which the bit body has a carbide coated cutting face.

2. Brief Description of the Prior Art

Rotary drill bits used in earth drilling are primarily of two major types. One major type of drill bit is the roller cone bit having three legs depending from a bit body which support three roller cones carrying tungsten carbide teeth for cutting rock and other earth formations. Another major type of rotary drill bit is the diamond bit which has fixed teeth of industrial diamonds supported on the drill body or on metallic or carbide studs or slugs anchored in the drill body.

There are several types of diamond bits known to the drilling industry. In one type, the diamonds are a very small size and randomly distributed in a supporting matrix. Another type contains diamonds of a larger size positioned on the surface of a drill shank in a predetermined pattern. Still another type involves the use of a cutter formed of a polycrystalline diamond supported on a sintered carbide support.

Some of the most recent publications dealing with diamond bits of advanced design, relevent to this invention, consists of Rowley, et al. U.S. Pat. No. 4,073,354 and Rohde, et al. U.S. Pat. No. 4,098,363. An example of cutting inserts using polycrystalline diamond cutters and an illustration of a drill bit using such cutters, is found in Daniels, et al. U.S. Pat. No. 4,156,329.

The most comprehensive treatment of this subject in the literature is probably the chapter entitled STRATAPAX bits, pages 541–591 in ADVANCED DRILLING TECHNIQUES, by William C. Maurer, The Petroleum Publishing Company, 1421 South Sheridan Road, P.O. Box 1260, Tulsa, Oklahoma, 74101, published in 1980. This reference illustrates and discusses in detail the development of the STRATAPAX diamond cutting elements by General Electric and gives several examples of commercial drill bits and prototypes using such cutting elements.

The hardfacing of roller bit bodies with tungsten carbide has been known for many years. Tungsten carbide hardfacing has been applied to the bit body prior to final assembly. Conventional hardfacing techniques, however, require the use of sufficiently high temperatures for application of the tungsten carbide coatings that the metallurgical properties of the steel body may be adversely affected. Attempts have been made to apply tungsten carbide coatings to bit bodies by conventional plasma spraying systems and by explosive-type coating methods. Such systems produce only very thin coatings and either do not adhere to the steel surface adequately or are too thin to withstand the severe conditions encountered in earth drilling.

Hardfacing of drilling tools, including tool joints, drill collars and rotary cone bits is found several places in the patent literature and summary of the art as of about 1970 is given in HISTORY OF OIL WELL DRILLING, J. E. Brantly, Gulf Publishing Co., 1971, pp. 1028, 1029, 1081.

SUMMARY OF THE INVENTION

One of the objects of this invention is to provide a new and improved drill bit having diamond insert cutters and an improved wear resistant cutting face.

Another object is to provide a drill bit having diamond cutting inserts with an improved tungsten carbide coated cutting face.

Another object is to provide an improved drill bit having diamond cutter inserts with a tungsten carbide coated cutting face in which the coating is metallurgically bonded to the bit body and of a thickness giving wear substantially equal to the life of the cutting inserts.

Still another object is to provide an improved drill bit having diamond cutter inserts with a tungsten carbide coated cutting face in which the coating is metallurgically bonded to the bit body by a very high velocity plasma arc process and is of a thickness about 12–40 mils giving wear substantially equal to the life of the cutting inserts.

Yet another object is to provide a new and improved drill bit having diamond insert cutters of the type consisting of a cylindrical stud having an angular supporting surface with a cutting disc bonded thereon consisting of sintered carbide having a cutting surface of polycrystalline diamond set in recesses in the cutting face which have milled offset recesses adjacent to the edges thereof which are sized and positioned to permit the cutting discs to be partially recessed and to restrain the cutting elements from rotation during use, the bit body being coated with tungsten carbide, after assembly of the cutters therein, to a thickness of about 12–40 mils.

Other objects and features of this invention will become apparent from time to time throughout the specification and claims as hereinafter related.

The foregoing objectives are accomplished by a drill bit for connection on a drill string which has a hollow tubular body with an end cutting face provided with a tungsten carbide coated surface and an exterior peripheral stabilizer surface with cylindrical sintered carbide inserts positioned therein.

Nozzle passages extend from the interior of the bit body through the cutting face for receiving a removable and interchangeable nozzle member therein. The cutting face has a plurality of recesses therein which receive, by an interference fit, a plurality of cutting elements of the type known as STRATAPAX, consisting of a cylindrical stud having an angular supporting surface with a cutting disc bonded thereon consisting of sintered carbide having a cutting surface of polycrystalline diamond.

The recesses in the cutting face have milled offset recesses adjacent to the edges thereof which are sized and positioned to permit the cutting discs to be partially recessed and to restrain the cutting elements from rotation during use.

The cutting face is coated with tungsten carbide to a thickness of 0.012–0.040 in. by means of a high-velocity, high-temperature plasma coating process after the cutting elements are assembled in the bit body. This process coats the steel bit body with tungsten carbide without coating or otherwise affecting the cutting inserts.

The coating is metallurgically bonded to the steel bit body and protects against wear during drilling for periods of several hundred hours.

BRIEF DESCRIPTION OF THE DRAWINGS

FIG. 1 is a view partly in elevation and partly in quarter section of an earth boring drill bit with diamond-containing cutting inserts and showing the carbide coated cutting face constituting a preferred embodiment of this invention.

FIG. 3 is a sectional view taken normal to the surface of the drill bit through one of the recesses in which the cutting inserts are positioned and showing the insert in elevation.

FIG. 4 is a sectional view in plan showing the hole or recess in which the cutting insert is positioned and the milled offset recess for the diamond cutter disc.

FIG. 8 is a view in elevation of one of the replaceable nozzle members.

FIG. 8A is a view in central section, slightly enlarged, of the nozzle member shown in FIG. 8.

FIG. 9 is an end view of the nozzle member shown in FIGS. 8 and 8A.

FIG. 10 is a view in section taken on the line 10—10 of FIG. 2.

FIG. 11 is a sectional view taken on the line 11—11 of FIG. 2.

FIG. 12 is a detail, enlarged sectional view of the removable and replaceable nozzle member shown in FIGS. 1 and 11 with the retaining ring shown in a partially exploded relation.

DESCRIPTION OF THE PREFERRED EMBODIMENTS

Figure 2:
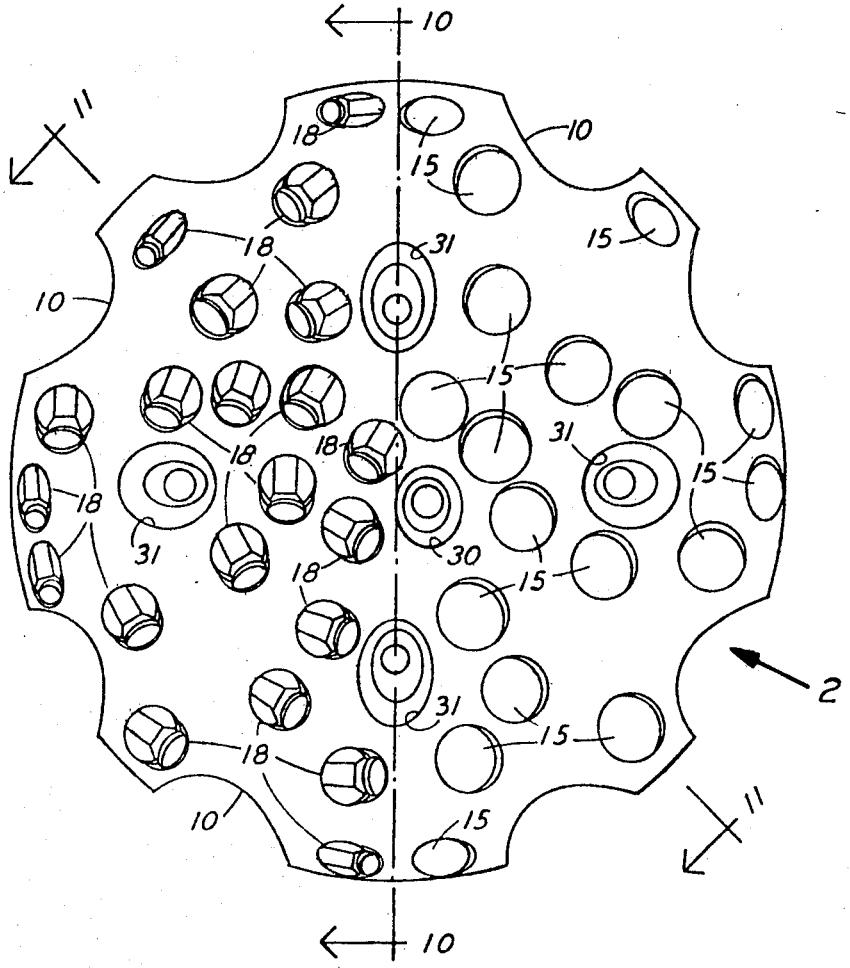
FIG. 2 is a plan view of the bottom of the drill bit shown in FIG. 1 showing half of the bit with cutting inserts in place and half without the inserts, showing only the recesses, and also showing the milled offset recesses into which the diamond cutters are recessed.
Figure 6:
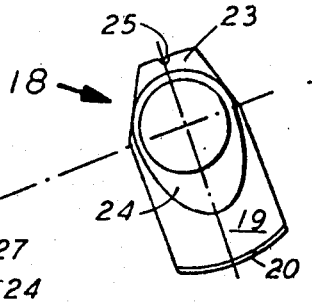
FIG. 6 is a view of one of the cutting inserts in plan relative to the surface on which the cutting element is mounted.

In the manufacture of earth drilling bits having diamond insert cutters, the drill bit body is formed in the desired shape and holes or recesses are provided into which diamond insert cutters are pressed. A variety of diamond insert type earth drilling bits have been available commercially but all are subject to the problem of excessive wear of the bit body by the erosive effect of the drilling mud and the rock cuttings produced by the bit during drilling operation. In fact, the problem of bit body erosion is so severe that the bit bodies often erode to the point where cutters and nozzles are lost before they are worn out. There has been a substantial need for an improvement in the bit bodies to provide for increased wear to the point that the bit body does not wear out before the diamond insert cutters.

The most obvious attack on this wear problem would be to provide some form of hardfacing similar to the hardfacing which is applied to the gage surface of roller bit bodies and to tool joints, drill collars and the like. This has been tried and rejected since the bit body for a diamond insert-type bit cannot be hardfaced prior to assembly of the cutters therein. This is true because the application of the hardfacing produces distortions which may require machining which is very difficult in the hardfaced product. The hardfacing cannot be applied by conventional hardfacing techniques after the diamond insert cutters have been assembled since the treating temperatures that are involved can damage the cutters and can cause distortion in the bit body itself.

Attempts have also been made to coat the bit bodies prior to assembly of the cutters with a thin layer of tungsten carbide applied by either a plasma spraying system or by an explosive gun-type coating system. These techniques have produced coatings that are very thin, e.g. 0.005–0.010 inch thick. Such coatings did not adhere adequately to the steel body and have been found to slough rapidly during drilling operation. Similar deficiencies are present when coatings have been applied after assembly of the cutters in the bit body.

Recently, a very high velocity plasma-type coating process has been developed by the Metal Products division of United Technologies, Inc. which makes possible the application of substantially thicker coatings of tungsten carbide on steel, which coatings are metallurgically bonded and have wear capabilities which are many times greater than any other tungsten carbide coatings that have been produced by prior art techniques.

Applicant has applied this coating process to the production of a diamond insert cutter-type drill bit in which the coating is applied after the cutters are assembled in place. The conditions of application are such that there is no metallurgical distortion of the bit body and no damage to the cutters. Furthermore, the coating is thicker and adheres metallurgically to the cutting face and coats the recesses associated with the cutter inserts and the replaceable drilling nozzles.

The product which is obtained in this manner is one which has been impossible to produce in the past and has wear resistant properties along the cutting face which result in a complete resistance to erosion for the life of the diamond insert cutters. Since this process is carried out after assembly of the diamond insert cutters in the bit body, it will be described in connection with a particular drill bit. The drill bit is that shown in FIGS. 1 to 12 of the drawings, although drill bits of other suitable design could be used in connection with this coating process. The construction of this drill bit will be described first and then the application of the coating process to produce the improved product.

Referring to the drawings by numerals of reference and more particularly to FIG. 1, there is shown a drill bit 1 having an improved arrangement for positioning the diamond insert cutters which represents a preferred embodiment of the invention. Drill bit 1 is illustrated as having replaceable drilling nozzles held in place by a threaded arrangement which is particularly useful in this bit because of the close proximity of the nozzles to the cutting surface of the bit and the bottom of the drill hole which results in a very high rate of wear.

The particular drill bit shown includes many features found in a drill bit described in the copending U.S. patent application of Mahlon Dennis, Ser. No. 158,389, filed June 11, 1980 and applicant's copending applications Ser. No. 220,306, filed Dec. 29, 1980 (which discloses an improved arrangement for securing replaceable nozzles in drilling bits by means of a metal or hard metal retaining ring) and Ser. No. 296,811, filed Aug. 27, 1981 (which discloses and claims the threaded arrangement for securing the nozzles in place) and Ser. No. 303,960, filed Sept. 21, 1981 (which discloses and claims an improved cutter insert arrangement utilizing a milled offset recess adjacent the several cutter recesses).

Drill bit 1 comprises a tubular body 2 which is adapted to be connected as by a threaded connection 3 to a drill collar 4 in a conventional drill string. The body 2 of drill bit 1 has a longitudinally extending passage 5 terminating in a cavity 6 formed by end wall 7 which is the cutting face of the drill bit. The cutting face of the drill bit body is provided with a 12–40 mil coating of tungsten carbide in the manner described below.

Drill bit 1 has a peripheral stabilizer surface 8 which meets the cutting face 7 at the gage cutting edge portion 9. The stabilizer portion 8 is provided with a plurality of grooves or courses 10 which provide for flow of drilling mud or other drilling fluid around the bit during drilling operation. The stabilizer surface 8 is provided with a plurality of cylindrical holes or recess 11 in which are positioned hard metal inserts 12. The hard metal inserts 12 are preferably of a sintered carbide and are cylindrical in shape and held in place in recesses 11 by an interference fit with the flat end of the insert being substantially flush with the stabilizer surface 8.

The cutting surface or cutting face 7 of the drill bit body 2 is preferably a crown surface defined by the intersection of outer conical surface 13 and inner negative conical surface 14. The crown surfaces 13 and 14 are provided with a plurality of sockets or recesses 15 spaced therearound in a selected pattern. As will be seen from the bottom plan view in FIG. 2, the sockets or recesses 15 and the cutting inserts which are positioned therein are arranged in substantially a spiral pattern. In FIGS. 3 and 4, the sockets or recesses 15 are shown in more detail with the cutting inserts being illustrated.

Each of the recesses 15 is provided with a milled offset recess 16 at the edge where the cutting surface 7 is intersected by the recess 15. Milled offset recess 16 is cut on one side of the hole or recess 15 and intersects substantially less than 180° of the circumference of the recess. The milled offset recesses are preferably of circular cross section taken longitudinally of recess 15 and circular cross section taken normal thereto. The milled offset recesses are sized to receive the cutting discs snugly, as described below. The tungsten carbide coating 61, applied as described below, covers the surface of the cutting face of the bit body and extends into and covers the surface of the milled offset recesses to prevent erosion of the steel from around the supporting studs of the cutters.

The recesses 15 in crown faces 13 and 14 receive a plurality of cutting elements 18 which are seen in FIGS. 1 and 2 and are shown in substantial detail in FIGS. 3, 5, 6 and 7. Cutting elements 18 are preferably STRATAPAX cutters manufactured by General Electric Company and described in Daniels, et al. U.S. Pat. No. 4,156,329, Rowley, et al. U.S. Pat. No. 4,073,354 and in considerable detail in ADVANCED DRILLING TECHNIQUES by William C. Maurer. The STRATAPAX cutting elements 18 consist of a cylindrical supporting stud 19 of sintered carbide. Stud 19 is beveled at the bottom as indicated at 20, has edge tapered surfaces 21 and 22, a top tapered surface 23 and an angularly oriented supporting surface 24.

Figure 5:
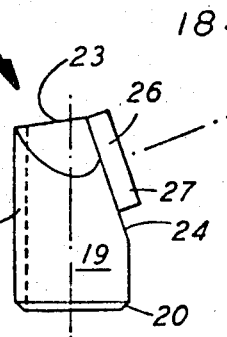
FIG. 5 is a view in side elevation of one of the cutting inserts.
Figure 5A:
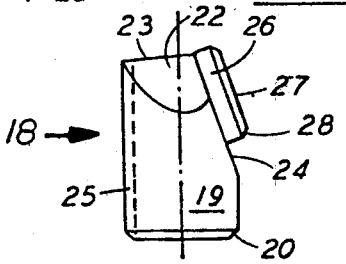
FIG. 5A is a view in side elevation of an alternate embodiment of one of the cutting inserts.
Figure 7:
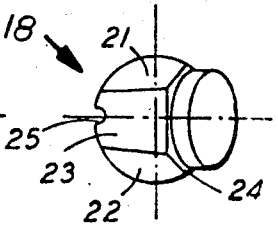
FIG. 7 is a top view of the cutting insert shown in FIG. 5.

A small cylindrical groove 25 is provided along one side of supporting stud 19. A disc shaped cutting element 26 is bonded on angular supporting surface 24, preferably by brazing or the like. Disc shaped cutting element 26 is a sintered carbide disc having a cutting surface 27 comprising polycrystalline diamond. In FIG. 5A, there is shown an alternate form of cutting element 18 in which the cutting surface 27 of polycrystalline diamond disc shaped cutter 26 is beveled around the peripheral edge as indicated at 28.

The relative size of supporting studs 19 of cutting elements 18 and the diameter of recesses 15 are selected so that cutting elements 18 will have a tight interference fit in the recesses 15. The recesses 15 are oriented so that when the cutting elements are properly positioned therein the disc shaped diamond faced cutters 26 will be positioned with the cutting surfaces facing the direction of rotation of the drill bit.

When the cutting elements 18 are properly positioned in sockets or recesses 15 the cutter disc 26 on supporting stud 19 is aligned with and recessed into the milled offset recess 16 on the edge of socket or recess 15. Because the offset milled recess is cut along a circular curvature at the top edge of recess 15 and intersects substantially less than 180° of that recess, the diamond cutter disc fits snugly in offset recess 16 which restrains the supporting stud 19 from rotation. Also, the fact that recess 15 grips stud 19 around substantially more than 180° insures that the stud and the cutters supported thereon are held more firmly in position.

Drill bit body 2 is provided with a centrally located nozzle passage 30 and a plurality of equally spaced nozzle passages 31 toward the outer part of the bit body. The nozzle passages 30 and 31 are designed to provide for the flow of drilling fluid, i.e. drilling mud or the like, to keep the bit clear of rock particles and debris as it is operated. The details of the nozzle construction are not essential to the improved design of the cutter retention recesses but are described because this nozzle construction is believed to be the best mode of securing nozzles in bit bodies.

The outer nozzle passages 31 are preferably positioned in an outward angle of about 10°–25° relative to the longitudinal axis of the bit body. The central nozzle passage 30 is preferably set at an angle of about 30° relative to the longitudinal axis of the bit body. The outward angle of nozzle passages 31 directs the flow of drilling fluid toward the outside of the bore hole and preferably ejects the drilling fluid at about the peak surface of the crown surface on which the cutting inserts are mounted.

This arrangement of nozzle passages and nozzles provides a superior cleaning action for removal of rock particles and debris from the cutting area when the drill bit is being operated. The proximity of the nozzles to the cutting surface, however, causes a problem of excessive wear which has been difficult to overcome. The erosive effect of rock particles at the cutting surface tends to erode the lower end surface of the bit body and also tends to erode the metal surrounding the nozzle passages. In the past, snap rings have usually been used to hold nozzles in place and these are eroded rapidly during drilling with annoying losses of nozzles in the hole.

The central nozzle passage 30 comprises passage 32 extending from drill body cavity 6 and has a counterbore 33 cut therein providing a shoulder 43. Counterbore 33 is provided with a peripheral groove 34 in which there is positioned an O-ring 35. Counterbore 33 is internally threaded as indicated at 33*a* and opens into an enlarged smooth bore portion 38 which opens through the lower end portion or face of the drill bit body.

A nozzle member 36 is threadedly secured in counterbore 33 against shoulder 43 and has a passage 37 providing a nozzle for discharge of drilling fluid. Nozzle member 36 is a removable and interchangeable member which may be removed for servicing or replacement or for interchange with a nozzle of a different size or shape, as desired.

Nozzle member 36 has its main portion formed of a hard metal, e.g. carbide or the like, with a smooth cylindrical exterior 38 and an end flange 39. Since hard metal is substantially unmachinable, it is virtually impossible to form threads in the nozzle member. A steel (or other suitable metal) sleeve 40 is brazed (or otherwise secured) to cylindrical nozzle portion 38 as indicated at 50 and has male threads 51 sized to be threadedly secured in the female threaded portion 33*a* of nozzle counterbore 33.

As seen in FIGS. 8, 8A and 9, the end face 41 of nozzle member 36 has recesses or indentations 42 formed therein which provide for insertion of a suitable wrench or tool for turning the nozzle member 36 to screw or unscrew the same for installation or removal. The peripheral surface of nozzle flange 39 fits the enlarged bore 38 of the nozzle-containing passage so that the nozzle member 36 can be threadedly installed in the position shown, with its end abutting shoulder 43. The face 41 of flange 39 shields the metal of threads 51 from abrasive wear or erosion.

The threaded arrangement for securing nozzle members 36 in place avoids the problem encountered when snap rings are used for retention, viz. erosive wear and breakage of the snap rings with loss of nozzles in the bottom of the boreholes. There is a further problem, however, with the threaded connection in that the nozzle may become unscrewed during use and lost in the hole.

This problem can be overcome by use of locking type screw threads but such an arrangement has the disadvantage of making removal and replacement of the nozzles more difficult. Another arrangement for solving this problem is for the apparatus to be provided with a retaining ring 44 which protects the nozzle member 36 and the enlarged bore portion 38 against wear and prevents the nozzles from unscrewing and becoming lost downhole.

In FIG. 10, the nozzle passages 31 are shown in some detail with the nozzle member 36 in place but without the retaining ring 44. In the nozzle passages 31, each nozzle passage 32*a* opens from body cavity 6 and is intersected by counterbore 33*a*. In FIG. 10, nozzle member 36 is shown unsectioned so that only the exterior cylindrical surface is seen. O-ring 35 is seen in full elevation surrounding the cylindrical surface 38 of nozzle member 36 and extending into peripheral groove 34.

There is a considerable advantage to the use of nozzle members threadedly secured as shown in FIGS. 10–12 and particularly extending at the angles described. In FIGS. 11 and 12, the retaining rings 44 are shown in more detail. These rings are press fitted in place and secure the nozzle members 36 against loss by uncrewing. Rings 44 also provide protection to the end of the nozzle members and to the metal of the bit body surrounding the enlarged bore portion 38. In FIG. 12, nozzle member 36 is shown positioned in place against shoulder 43 with the O-ring 35 providing the desired seal against leakage. In this view, retaining ring 44 is shown both in place and in exploded relation.

Retaining ring 44 is an annular ring having a cylindrical outer surface 45 and flat end surfaces 46 and 47. A peripheral bevel 48 is provided at the intersection of outer surface 45 and end face 46. The inner opening 49 is of adequate size to permit unobstructed flow of drilling fluid from nozzle passage 37. Opening 49 may be cylindrical or any other desired configuration, but is preferably a conical surface, as shown, flaring outward toward the end of passage 31 opening through the cutting face 7 of bit body 2. Retaining ring 44 has its outer surface 45 very slightly larger than the inner surface or bore of passage 31 and has an interference fit therein. The bevel 48 on retaining ring 44 permits the ring to be pressed into the slightly smaller bore of passage 31 without cutting or scoring the bit body. The retaining ring 44 is preferably oversize by about 0.002–0.004 inch in relation to the bore of passage 31.

Retaining ring 44 is preferably of a hardened steel or a hard metal, such as sintered tungsten carbide. Retaining rings 44 may be used in the retention of all of the nozzle members 36 against unscrewing. Retaining rings 44 hold nozzle members 36 tightly in place to prevent unscrewing and to protect against erosion or wear during use. Retaining rings 44 can be drilled out or removed by suitably designed tools for exchange or replacement of the nozzle members 36 in the field. The application of the tungsten carbide coating in the manner described below is effective to coat the nozzle passages to prevent erosion and wear.

COATING METHOD AND APPARATUS

The hardfacing of roller bit bodies with tungsten carbide has been known for many years. Tungsten carbide hardfacing has been applied to the bit body prior to final assembly. Conventional hardfacing techniques, however, require the use of sufficiently high temperatures for application of the tungsten carbide coatings that the metallurgical properties of the steel body and the diamond cutter may be adversely affected. Attempts have been made to apply tungsten carbide coatings to bit bodies by conventional plasma spraying systems and by explosive-type coating methods. Such systems produce only very thin coatings which do not adhere to the steel surface adequately to withstand the severe conditions encountered in earth drilling.

Hardfacing of drilling tools, including tool joints, drill collars and rotary cone bits is found several places in th patent literature and summary of the art as of about 1970 is given in HISTORY OF OIL WELL DRILLING, J. E. Brantly, Gulf Publishing Co., 1971, pp. 1028, 1029, 1081.

Figure 13:
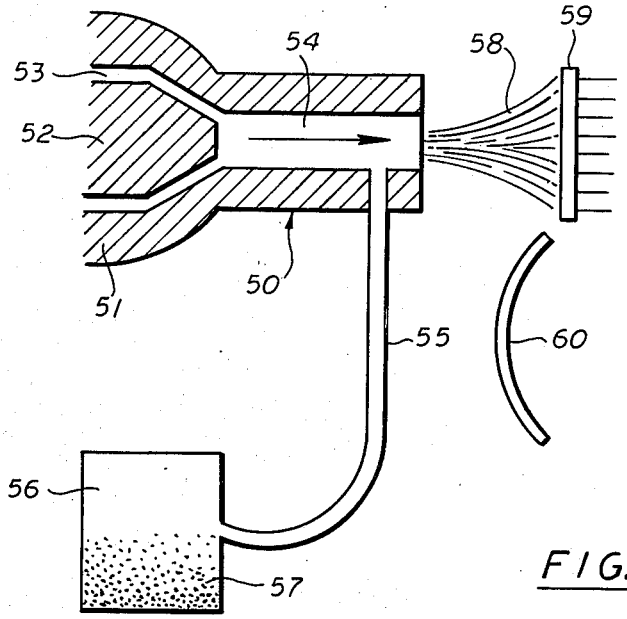
FIG. 13 is a schematic diagram of the process and apparatus for coating the bit body cutting face with tungsten carbide.

In FIG. 13, there is shown a schematic of an improved apparatus and method for applying a thick tungsten carbide coating metallurgically bonded to the cutting face of the drill bit body. The apparatus consists of a DC arc-plasma torch 50 provided with water cooled concentric electrodes 51 and 52. The annular passage 53 around electrode 52 opens into exit passage 54. Passage 54 communicates by way of supply tube 55 to reservoir 56 where a quantity of tungsten carbide particles 57 are provided.

Figure 14:
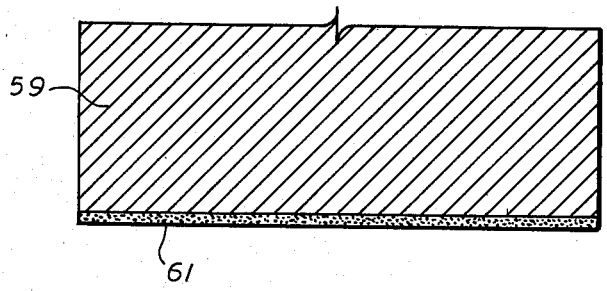
FIG. 14 is an enlarged view in cross section of a portion of the cutting face showing the tungsten carbide coating thereon.

An inert gas (argon, nitrogen, etc.) is passed through annulus 53 and passage 54 where it entrains tungsten carbide particles which are completely liquidized at the temperatures encountered in the plasma and ejected in a stream as indicated at 58 onto the surface or substrate 59, e.g., the cutting face of the bit body, where a coating is to be formed. Tube 60 is shown in position to circulate an inert cover gas over the surface being reated. In FIG. 14, substrate 59 (which may be the cutting face of the bit body or any other metal substrate being coated) is shown provided with a coating 61 of tungsten carbide. In FIG. 1, the coating 61 is the entire cutting face 13 and 14 of drill bit 1. The coating 61 covers the entire face and includes a coating of the interior of the nozzle passages and also the recessed areas around the cutting inserts.

The basics of the DC arc-plasma generation are relatively simple and are shown in FIG. 13 of the drawing. Two concentric water-cooled electrodes 51 and 52 are employed as a plasma generator. An inert gas is passed between the electrodes through annular space 53 and an arc is triggered (by RF spark) which is then sustained by a high-current DC power supply. The arc produces an ionized gas stream with temperatures which may exceed 30,000° F.

Rapid expansion of the gas occurs in the confinement of an aerodynamically shaped front electrode which causes the ionized plasma to obtain velocities approaching Mach I in conventional (40 kw power supply) systems and in excess of Mach II in high energy (80 kw power supply) systems. Linear gas velocities in excess of 10,000 ft./sec. are attainable and velocities of 9,600 ft./sec. are used in coating bit bodies in accordance with this invention.

Although the temperatures may approach 60,000° F. in high energy equipment at the foot of the arc, the plasma has substantially cooled to more reasonable limits by the time it reaches a powder injection port. Although the sketch shows the powder injection port as an internal part of the front nozzle, it may also be mounted externally to the gun assembly.

The several manufacturers of plasma spray equipment use similar type materials in construction of the generator or gun. Oxygen-free copper is the universal choice for the front electrode and this is separated from the thoriated tungsten rear electrode by a composite material of good high temperature dielectric properties. The gun electrodes are not considered to be "consumable" but there is a finite life on these items due to hot-gas erosion, arc erosion, and even powder abrasion.

The material (tungsten carbide) to be sprayed is supplied in powder form via a carrier gas to the plasma stream where the powder is melted and accelerated at velocities approaching that of the hot plasma gas. These molten particle velocities are normally subsonic for conventional (40 kw) equipment but can actually be increased to Mach III using special spray chambers. The molten powder can be manually applied to the surface in a manner analogous to a paint spraying operation except that a high degree of skill is required to maintain relatively constant traverse velocities and torch-to-substrate distance.

In most instances, it is far better to automate the system so that distances and traverse speeds are held constant during the operation. By control of torch motion relative to the substrate, a uniform deposit is built up as the molten particles impinge and rapidly quench against its surface. Both thermal and kinetic energies play an important role in the bonding of the deposit to the substrate; but surprisingly, the temperature of the substrate is readily controlled to below 200° F. in most cases.

Kinetic and thermal energies of the molten particles provide the major share of energy contribution to the film developed on the substrate. This total energy, $E_t$ is acquired by a particle as it moves towards its target within the confines of the plasma stream and is expressed as a summation of the kinetic energy (KE)+the thermal energy ($H_t$).

$$E_t = mH_t \quad (1)$$

$m$ = mass of particle

The thermal energy, $H_t$ is the sum of the heat capacity of this material in solid form ($H_{cs}$)+the latent heat fusion ($H_f$)+the heat capacity of the melt ($H_{cm}$)+perhaps a portion of the latent heat of vaporization ($H_v$) as expressed in the equation:

$$H_t = H_{cs} + H_f + H_{cm} + RH_v \quad (2)$$

"R" is a constant, ranging from 0 to 1, which must be less than unity so that complete vaporization of the particles will not occur.

If vaporization does occur, either no coating will develop or a porosity associated with entrained gases may result. Given a nicely melting material and a uniform particle distribution, it is easy to see that the heat energy, $mH_h$, can be optimized for the various types of plasma spray equipment provided that an adequate length of time in flight can be provided to assure full capture of the available heat energy potential for the given particle mass.

Bonding forces are the result of the release of the total energy ($E_t$) at the moment of impact (plus nonoseconds thereafter). Bonding of these particles has generally been described as "quasi-metallurgical" consisting of a combination of the mechanical interlocking bonds, Vander Waals forces and in some cases, microchemical diffusion. The latter has been observed for a number of materials, particularly those which have an exothermic component. Supsequent bonding of additional particles as the coating begins to build up creates an added component of remelt associated with it since freshly impacted particles still will retain a significant portion of their total energy as provided by the heat capacity ($H_{cf}$) which is a component of $H_t$ in equation No. 1.

In using this process to coat the bit body 2 with tungsten carbide along its cutting face, the bit is completely assembled as seen in FIG. 1 with the cutting inserts 18 and replaceable nozzles 44 in position, as shown. The bit body is preferably of 4130 steel.

The tungsten carbide particles which are used in the coating process are of very fine mesh and preferably consist of 55–60% by volume of tungsten carbide and 40–45% by volume of cobalt. The process is carried out using the DC arc-plasma torch described above which operates at a very high linear gas velocity.

The gas is ejected from the plasma torch at linear speeds well in excess of 4,000 ft./sec. In fact, under the preferred conditions for coating the drill bit body, the torch is operated at a linear gas flow of 9,600 ft./sec. The temperature of the tungsten carbide particles in the plasma stream is about 6,000° F. as the plasma stream leaves the torch.

The temperature of the plasma stream drops very rapidly after leaving the DC arc-plasma torch and the molten particles of tungsten carbide and cobalt impinge onto the steel bit body surface and are rapidly cooled. As a result, the bit body is never heated to a temperature above about 200° F. and therefore does not become distorted by the coating process, or damage the (STRATAPAX) diamond cutters which have a practical temperature limit of 1300° F.

The coating which builds up on the surface reaches a thickness of 12 to 40 mils (0.012–0.040 in) or thicker. The preferred thickness for this coating is about 30–40 mils. The tungsten carbide coating is fused to and metallurgically bonded to the surface of the steel bit body. The coating is very dense and essentially non-porous. The coating which is formed adheres only to the steel and follows the contour of the cutting face of the bit body and coats the inner surface of the nozzle passages and the milled offset recesses adjacent the diamond cutter discs.

This entire surface which is coated with a relatively thick, e.g. 30–40 mil, coating of tungsten carbide and cobalt (or other suitable binder) is highly resistant to impact and to wear during normal use of the drill bit. As a result, this wear-resistant surface is not eroded by the drilling mud and the rock cuttings from the drilling operation over several hundred hours of operation. The tungsten carbide coated surface reists wear to an extent that it markedly increases bit life so that bits often no longer wear away before the diamond cutters have worn out.

The advantages of wear resistance which are attained by this invention cannot be obtained by other prior art procedures for coating surfaces with tungsten carbide. As noted above, the drill bit body cannot be given a conventional hardfacing treatment either prior to or after assembly of the diamond cutter inserts because of the damage to the diamond inserts which is produced and also because of the distortion of the bit body. Other "metallizing" processes of the prior art for application of tungsten carbide coatings have been evaluated and found to be ineffective. Conventional metallizing processes and conventional plasma coating processes and explosive coating processes have been found to produce tungsten carbide coatings which do not exceed 10 mils in thickness and are usually much thinner (usually no more than 5 mils). These coatings have been found to be completely ineffective in resisting wear and often break up or slough off under conditions of impact and friction encountered in a drilling operation.

OPERATION

The operation of this drill bit should be apparent from the foregoing description of its component parts and method of assembly. Nevertheless, it is useful to restate the operating characteristics of this novel drill bit to make its novel features and advantages clear and understandable.

The drill bit as shown in the drawings and described above is primarily a rotary bit of the type having fixed diamond surfaced cutting inserts. Most of the features described relate only to the construction of a diamond bit. The use of retaining rings 44 and the threaded, replaceable nozzle members 36, as shown in FIGS. 1, 11, and 12, is of more general application.

This arrangement for retention of the removable and interchangeable nozzle members is useful in a diamond bit as described and shown herein but would also be of like use in providing for the retention of removable and interchangeable nozzle member in roller bits, particularly when equipped with extended nozzles, or any other bits which have a flow of drilling fluid through the bit body and out through a flow directing nozzle. The threaded arrangement for releasably securing the nozzle members in place is therefore considered to be of general application and not specifically restricteed to the retention of nozzles in diamond cutter insert type bits.

In operation, this drill bit is rotated by a drill string through the connection by means of the drill collar 4 shown in FIG. 1. Diamond surfaced cutting elements 18 cut into the rock or other earth formations as the bit is rotated and the rock particles and other debris is continuously flushed by drilling fluid, e.g. drilling mud, which flows through the drill string and the interior passage 5 of the drill bit and is ejected through nozzle passages 30 and 31 as previously described.

The central nozzle 30 is set at an angle of about 30° to flush away cuttings and debris from the inside of the cutting crown. The outer nozzle passages 31 are set at an angle of 10°–25° outward relative to the longitudinal axis of the drill bit body. These nozzle passages emerge through the cutting face at about the peak of the crown cutting surface. This causes the drilling fluid to be ejected toward the edges of the bore hole and assists in flushing rock particles and cuttings and debris away from the cutting surface. As noted above in the description of construction and assembly, the nozzle passages 30 and 31 are formed by removable nozzle members 36 which are held in place by threads 51 in sleeve 40 and secured against unscrewing by retaining rings 44 secured by an interference fit.

The peripheral surface or stabilizer surface 8 of drill bit body 2 is provided with a plurality of sintered carbide cylindrical inserts 12 positioned in sockets or recesses 11 thereof. These inserts protect stabilizer surface 8 against excessive wear and assist in keeping the bore hole to proper gage to prevent the drill bit from binding in the hole. The grooves or courses 10 in stabilizier surface 8 provide for circulation of drilling fluid, i.e. drilling mud, past the drill bit body 2 to remove rock cuttings and debris to the surface.

As previously pointed out, the construction and arrangement of the cutting elements and the method of assembly and retention of these elements is especially important to the operation of this drill bit. The drill bit is designed to cut through very hard rock and is subjected to very substantial stresses. Typical cutting elements 18 are STRATAPAX cutting elements manufactured by General Electric Company and consist of diamond surfaced cutting discs supported on carbide studs as described above.

The milled offset recess 16 adjacent to the socket or recess 15 in which cutting element stud 19 is fitted allows for cutting disc 26 to be partially recessed below the surface of the cutting face of the drill bit and also provides for relieving the stress on the drill bit during the cutting operation. The engagement of cutting disc 26 with the surface of milled offset recess 16 assists in retaining cutting element 18 in position and protecting it against twisting movement during cutting operation of the drill bit.

The arrangement of cutting elements 18 in a spiral pattern on the crown cutting surface, as shown in FIG. 2, provides for a uniform cutting action on the bottom of the bore hole. The cutters 18 which lie on the outer conical cutting surface 15 function to cut the gage of the bore hole and these cutters together with the carbide inserts 12 in the stabilizer surface 8 function to hold the side walls of the bore hole to proper gage and prevent binding of the drill bit in the bore hole.

The use of a tungsten carbide coated bit body produced as described above has improved the wear resistance to a point where the cutting face lasts substantially as long as the cutter inserts. As described above, the bit body is produced with a tungsten carbide coating about 30–40 mils thick which is fused to and metallurgically bonded to the 4130 steel substrate. The coating is applied after the cutter inserts are assembled and intimately follows the surface of the cutting face including the milled offset recesses and the nozzle passages without coating or otherwise affecting the cutter inserts. This coated bit body is resistant to impact and abrasive wear and thus extends the life of the bit beyond all previous expectations.

While this invention has been described fully and completely with special emphasis upon a single preferred embodiment, it should be understood that within the scope of the appended claims the invention may be practiced otherwise than as specifically described herein.

I claim:

1. A method of producing a drill bit which comprises providing a drill body of a steel alloy having a hollow tubular body adapted to be connected to a drill string, said drill body having an exterior peripheral stabilizer surface and an end cutting face, said end cutting face having a plurality of recesses spaced therearound in a selected pattern, positioning a plurality of cutting elements one in each of said recesses and extending outward from said end cutting face, applying a coating of tungsten carbide on said cutting face, after assembly of said cutting elements therein, in a plasma arc spray without raising the temperature of the bit body above about 200° F. or raising the temperature of said cutting elements above about 1300° F., to a thickness in excess of 12 mils, dense, non-porous, and metallurgically bonded to said surface.

2. A method according to claim 1 in which said tungsten carbide coating is applied by dispersing fine tungsten carbide particles into a plasma arc at a temperature sufficient to melt said particles, and projecting said molten particles onto said cutting face at a high linear velocity such that said molten particles solidify as a coating thereon which is dense, coherent, non-porous and metallurgically bonded to said surface.

3. A method according to claim 2 in which said plasma arc heats said tungsten carbide particles to a temperature of about 6,000° F. and the gas flow therethrough carries said molten tungsten carbide at a linear velocity in excess of 4,000 ft./sec.

4. A method according to claim 1 in which said tungsten carbide coating is built up in layers to a thickness of 40–50 mils.

5. A method according to claim 3 in which said plasma arc is produced by passing an arc through an inert gas stream to produce an ionized gas at a temperature of about 30,000° F., and ejecting the heated gas stream with the tungsten particles entrained therein at a linear velocity in excess of 4,000 ft./sec.

6. A method of producing a drill bit which comprises providing a drill body of a steel alloy having a hollow tubular body adapted to be connected to a drill string, said drill body having an exterior peripheral stabilizer surface and an end cutting face, said end cutting face having a plurality of recesses spaced therearound in a selected pattern, positioning a plurality of cutting elements one in each of said recesses and extending outward from said end cutting face, applying a coating of tungsten carbide on said cutting face, after assembly of said cutting elements therein, in a plasma arc spray without raising the temperature of the bit body above about 200° F. or raising the temperature of said cutting elements above about 1300° F., to a thickness in excess of 12 mils, dense, non-porous, and metallurgically bonded to said surface said cutting elements each comprising a cylindrical supporting stud of sintered carbide having an angularly oriented supporting surface with a disc shaped element bonded thereon comprising a sintered carbide disc having a cutting surface comprising polycrystalline diamond, each of said cutting elements being positioned in one of said recesses by an interference fit, and said tungsten carbide coating being only on said cutting face, said cutting elements being free of said coating.

7. A method of producing a drill bit which comprises providing a drill body of a steel alloy having a hollow tubular body adapted to be connected to a drill string, said drill body having an exterior peripheral stabilizer surface and an end cutting face, said end cutting face having a plurality of recesses spaced therearound in a selected pattern, positioning a plurality of cutting elements one in each of said recesses and extending outward from said end cutting face, applying a coating of tungsten carbide on said cutting face, after assembly of said cutting elements therein, in a plasma arc spray without raising the temperature of the bit body above about 200° F. or raising the temperature of said cutting elements above about 1300° F., to a thickness in excess of 12 mils, dense, non-porous, and metallurgically bonded to said surface each of said recesses having a milled offset recess at its surface opening edge, of circular curvature in section and intersecting the circumferential edge of said recess for substantially less than 180° of the circumference thereof, said cutting elements each comprising a cylindrical supporting stud of sintered carbide having an angularly oriented supporting surface with a disc shaped element bonded thereon comprising a sintered carbide disc having a cutting surface comprising polycrystalline diamond, each of said cutting elements being positioned in one of said recesses by an interference fit with said disc shaped element partially recessed in and abutting said milled offset recess at the surface opening thereof, said milled offset recesses each being positioned to orient said discs with their cutting surfaces facing the direction of rotation of the bit and being of a size relieving stresses on said supporting studs during cutting operation and resisting twisting movement of said studs, and said tungsten carbide coating being only on said cutting face, said cutting elements being free of said coating.

8. A method of producing a drill bit which comprises providing a drill body of a steel alloy having a hollow tubular body adapted to be connected to a drill string, said drill body having an exterior peripheral stabilizer surface and an end cutting face, said end cutting face having a plurality of recesses spaced therearound in a selected pattern, positioning a plurality of cutting elements one in each of said recesses and extending outward from said end cutting face, applying a coating of tungsten carbide on said cutting face, after assembly of said cutting elements therein, in a plasma arc spray without raising the temperature of the bit body above about 200° F. or raising the temperature of said cutting elements above about 1300° F., to a thickness in excess of 12 mils, dense, non-porous, and metallurgically bonded to said surface, said bit body including a plurality of passages extending through said cutting face, a plurality of removable and replaceable nozzles positioned one in each of said passages, and said tungsten carbide coating covering said cutting face extending into and coating said nozzle-containing passages.

9. A method of producing a drill bit which comprises providing a drill body of a steel alloy having a hollow tubular body adapted to be connected to a drill string, said drill body having an exterior peripheral stabilizer surface and an end cutting face, said end cutting face having a plurality of recesses spaced therearound in a selected pattern, positioning a plurality of cutting elements one in each of said recesses and extending outward from said end cutting face, applying a coating of tungsten carbide on said cutting face, after assembly of said cutting elements therein, in a plasma arc spray without raising the temperature of the bit body above about 200° F. or raising the temperature of said cutting elements above about 1300° F., to a thickness in excess of 12 mils, dense, non-porous, and metallurgically bonded to said surface, said peripheral stabilizer surface having a plurality of recesses therein, and flat ended tungsten carbide inserts positioned one in each of said last named recesses to provide wear protection for said stabilizer surface.

10. A method of producing a drill bit comprising providing a drill body of 4130 steel alloy having a hollow tubular body adapted to be connected to a drill string, said drill body having an exterior peripheral stabilizer surface and an end cutting face, said end cutting face having a plurality of recesses spaced therearound in a selected pattern, positioning a plurality of cutting elements one in each of said recesses and extending outward from said end cutting face, applying a coating of tungsten carbide on said cutting face, after assembly of said cutting elements therein, in a plasma arc spray without raising the temperature of the bit body above about 200° F. or raising the temperature of said cutting elements above about 1300° F., to a thickness in excess of 12 mils, dense, non-porous, and metallurgically bonded to said surface.

11. A drill bit produced by the method of claim 1.

12. A drill bit produced by the method of claim 2.

13. A drill bit produced by the method of claim 3.

14. A drill bit produced by the method of claim 4.

15. A drill bit produced by the method of claim 5.

* * * * *